US005820691A

United States Patent [19]

Hartman

[11] Patent Number: 5,820,691

[45] Date of Patent: Oct. 13, 1998

[54] BACKUP ASSEMBLY AND METHOD FOR CHEMICAL SANITIZING IN A SANITIZING ZONE OF A POT AND PAN SINK

[76] Inventor: Jerry M. Hartman, Rte. 1, Box 278-E, Hwy. 27, Lillington, N.C. 27546

[21] Appl. No.: 953,732

[22] Filed: Oct. 17, 1997

Related U.S. Application Data

[63] Continuation-in-part of Ser. No. 604,806, Feb. 23, 1996, Pat. No. 5,679,173.

[51] Int. Cl.[6] ..... A47L 15/44

[52] U.S. Cl. ..... 134/18; 134/25.2; 134/57 D; 134/99.2; 134/105; 134/113

[58] Field of Search ..... 134/18, 25.2, 56 D, 134/57 D, 58 D, 99.2, 105, 113

[56] References Cited

U.S. PATENT DOCUMENTS

| | | |
|---|---|---|
| 2,747,588 | 5/1956 | Bonner . |
| 2,843,137 | 7/1958 | Federighi . |
| 2,941,725 | 6/1960 | Federighi . |
| 2,947,311 | 8/1960 | Fox et al. . |
| 3,011,722 | 12/1961 | Federighi . |
| 3,139,890 | 7/1964 | Moran . |
| 3,896,827 | 7/1975 | Robinson . |
| 4,134,003 | 1/1979 | Hahn . |
| 4,147,559 | 4/1979 | Fraula et al. . |
| 4,277,290 | 7/1981 | Andrews et al. . |
| 4,285,352 | 8/1981 | McMahon et al. . |
| 4,689,089 | 8/1987 | Eberhardt, Jr. . |
| 4,756,321 | 7/1988 | Livingston et al. . |
| 5,038,807 | 8/1991 | Bailey et al. . |
| 5,267,580 | 12/1993 | Payzant . |
| 5,462,606 | 10/1995 | Burns ..... 134/18 |

*Primary Examiner*—Philip R. Coe
*Attorney, Agent, or Firm*—Neil F. Markva

[57] ABSTRACT

The invention is directed to a method and assembly for sanitizing foodware in a sanitizing zone of a high temperature warewashing machine. The method comprises providing a source of fluid sanitizing material that is effective to sanitize foodware and sensing the temperature of final rinse water being used to sanitize foodware disposed within the sanitizing zone during a final rinse operation of the warewashing machine. An actuating signal is produced when a sensed temperature of the final rinse water is outside the preselected sanitizing temperature range. A sufficient amount of the fluid chemical sanitizing material is then provided in the final rinse water to sanitize foodware disposed in the sanitizing zone when the sensed temperature of the final rinse water is outside a preselected sanitizing temperature range. The specific embodiment is directed to a warewashing pot and pan sink assembly.

25 Claims, 8 Drawing Sheets

BACKUP ASSEMBLY AND METHOD FOR CHEMICAL SANITIZING IN A SANITIZING ZONE OF A POT AND PAN SINK

RELATED APPLICATION

This application is a continuation-in-part application of application Ser. No. 08/604,806, filed Feb. 23, 1996, and now U.S. Pat. No. 5,679,173.

FIELD OF THE INVENTION

This invention relates to the sanitizing rinse cycle of high temperature foodware washing machines used in institutions, hospitals, restaurants, hotels and the like. More particularly, the invention relates to a backup sanitizing system for insuring the sanitization of foodware when the rinse water temperature of a high temperature foodware washing machine begins operating outside a standard foodware sanitizing temperature range.

BACKGROUND OF THE INVENTION

The institutional and commercial washing, rinsing, and sanitizing of foodware has typically fallen into two specific categories: High temperature and low temperature warewashing machines. High temperature machines sanitize foodware through the use of hot water. Pre-wash and initial rinse water temperatures are usually in the range of about 140° F. to about 160° F. The final rinse water is at least 180° F. to sterilize the foodware after cleaning. Low temperature machines chemically sanitize dishes at a lower rinse water temperature in the range of about 120° F. to about 160° F. Known chemical sanitizers used in low temperature machines include bactericidal agents such as liquid sodium hypochlorite (NaOCl), iodine, quaternary, iodophor, and chlorine each in concentrations well known in the art.

Both high temperature and low temperature warewashing machines have advantages and disadvantages. The high volume dish users such as restaurants, hospitals, and institutions, however, generally tend toward using high temperature warewashing machines. The most significant problem associated with this type machine is maintaining the temperature of the final rinse water within a standard foodware-sanitizing temperature range, which is generally governmentally prescribed.

To sanitize dishes, a National Sanitation Foundation document (N.S.F. 3 1982), adopted by the government as a standard, states that the temperature of the final rinse water "shall be maintained at not less than 180° F. (82° C.) and no more than 195° F. (90° C.) at the entrance of the manifold," which defines a final rinse operation zone of a warewashing machine. In other words, the temperature of the final rinse water must reach and be continually maintained in the range of 180° F. to 195° F. When this extremely high temperature is not present in the final rinse water of all existing high temperature warewashing machines, the dishes, glasses, silverware, and the like are not considered properly sanitized.

U.S. Pat. No. 4,147,559 discusses the difference between high temperature (180° F.–195° F.) and low temperature (120° F.–140° F.) warewashing machines and discloses a particular type of system for rinsing and chemically sanitizing foodware items in low temperature machines. The problem solved by the present invention is not recognized in this prior art patent that is limited to addressing the described problem existing in low temperature machines where the addition of chemical sanitizing agents is required because the rinse water temperature is not sufficient to sterilize the foodware.

U.S. Pat. No. 4,689,089 recognizes the importance of maintaining the water temperature in high temperature warewashing machines at the required level for proper sanitization of the foodware. To accomplish this result, the patentee provides a control system for regulating a thermostat-controlled water temperature at two different levels depending on whether the water pump of the warewashing machine is operating or not. The patentees neither recognize the problem of maintaining the sanitizing capacity of a high temperature foodware washing machine in the event of any malfunction in their water temperature control system or the thermostat-controlled water supply of the machine nor do they disclose any structure or method of overcoming such a problem if it did occur.

There are two types of warewashing machines: the conveyor-type and the "stationary rack" or batch-type. In the former, the conveyor advances the foodware, either individually or in racks, and either continuously or intermittently, through several specialized work stations or wash-operation zones within the machine. In the latter, a rack of foodware is disposed in a single or stationary position in a washing chamber while the machine automatically subjects the foodware to consecutive washing and rinsing operations defining a washing cycle of a series of pre-washing and rinsing, washing, and final rinsing operations. Some machines hold several racks at once with the machine operating through a washing cycle while the racks remain stationary. Both the conveyor and batch types of machine may be used to effect high temperature warewashing and therefore are subject to the problem addressed and solved by the present invention.

U.S. Pat. Nos. 2,947,311 and 5,267,580 generally disclose batch-type and conveyor-type warewashing machines to which the present invention may be adapted. This is also true of all the other warewashing machines disclosed in the prior art cited herein and operating with high temperature rinse water sanitizing cycles.

The following U.S. Patents disclose various dispensing systems for discharging detergents, drying agents, and/or chemical sanitizers into the flow of water used during various cycles of warewashing machines.

U.S. Pat. No. 2,747,588

U.S. Pat. No. 2,843,137

U.S. Pat. No. 2,941,725

U.S. Pat. No. 3,011,722

U.S. Pat. No. 3,139,890

U.S. Pat. No. 4,277,290

U.S. Pat. No. 4,285,352

Several of these prior art systems show the dispensing of chemicals into the rinse water spray. None of them, however, specifically teach the use of these dispensing systems to operate as a backup sanitizing system for a high temperature warewashing machine.

U.S. Pat. Nos. 3,896,827; 4,134,003; 4,756,321; and 5,083,807 each discloses controlling a particular performance characteristic of a warewashing machine, which might include the monitoring of various working parameters such as time, temperature, rinse pressure, detergent concentration level and responds with built-in corrective measures or an alarm for operating personnel to manually correct the problem being sensed. None of these prior art systems recognize or address the problem solved by the present invention, however.

In summary, existing warewashing machines take the foodware through an optional pre-wash step, and then effect washing and rinsing steps followed by a final rinse before the foodware is considered cleaned and sanitized. These method steps are effected in different chambers or tanks within the larger commercially available conveyor-type warewashing machines. In the single tank or chamber batch-type machines, different pumps controlled by timing units feed wash, rinse, and final rinse spray water systematically onto the foodware placed within the operations chamber to effect the cleaning and sanitizing method steps.

Many conditions make it difficult to maintain final rinse water temperature. Examples of such conditions include undersized or defective primary or booster water heaters, excessive supply water pressure, low temperature water being supplied to the warewashing machine, and excessive volume demands on the warewashing machine. When the final rinse water temperature is not maintained as required, the resultant washed dishes are not sanitized, government sanitizing requirements are not met, and significant negative consequences will naturally occur.

Purpose of The Invention

The primary object of the invention is to achieve the sanitizing of foodware washed in a high temperature warewashing machine despite the conditions that work to adversely affect the maintaining of the final rinse water temperature within the standard sanitizing temperature range, which is generally set by a governmental agency.

Another object of the invention is to overcome a problem associated with high temperature warewashing machines for many years without virtually any attempt in the industry to solve it.

A further object of the invention is to provide a backup system for chemically sanitizing foodware in a high temperature warewashing machine when the final rinse temperature is not properly maintained within the required sanitizing temperature range.

A still further object of the invention is to provide a method and assembly for sanitizing foodware in a pot and pan sink assembly including a sanitizing operation work zone and heating means for providing a bath of heated rinse water at an elevated preselected sanitizing temperature in the sanitizing work zone.

A still further object of the invention is to provide a backup sanitizing assembly for a high temperature pot and pan sink in which chemical sanitizing material is added to water used in a sanitizing work zone when the water temperature drops below a preselected sanitizing temperature.

SUMMARY OF THE INVENTION

The invention is directed to a method and assembly for sanitizing foodware in a sanitizing zone of a high temperature warewashing machine. The method comprises providing a source of fluid sanitizing material that is effective to sanitize foodware and sensing the temperature of final rinse water being used to sanitize foodware disposed within the sanitizing zone during a final rinse operation of the warewashing machine. Actuating signal means is produced when a sensed temperature of the final rinse water is outside the preselected sanitizing temperature range. A sufficient amount of the fluid chemical sanitizing material is then provided in the final rinse water to sanitize foodware disposed in the sanitizing zone when the sensed temperature of the final rinse water is outside a preselected sanitizing temperature range.

The chemical sanitizing material may be selected from any group of germicide agents such as sodium hypochlorite, iodine, quaternary, iodophor, and chlorine. More specifically, the chemical sanitizing material may be designed to produce chlorine on the foodware disposed in the sanitizing zone. The amounts used in the invention conform to those suggested by the suppliers to sanitize the foodware.

The assembly of the invention comprises supply means for providing a source of the fluid sanitizing material and temperature sensing means includes thermostat means for monitoring the temperature of final rinse water being used to sanitize foodware disposed within the sanitizing zone during a final rinse operation of the warewashing machine. Thus, the final rinse operation of the warewashing machine must be activated so that the final rinse water is being sprayed into the sanitizing operation work zone of the warewashing machine. Dispensing means provides a sufficient amount of the fluid sanitizing material in the final rinse water to sanitize foodware disposed in the sanitizing zone when the final rinse water temperature is outside a preselected sanitizing temperature range, which is generally 180° F. to 195° F.

Different embodiments of the supply means include container means for either a liquid or a dry particulate chemical sanitizing material. The dispensing means includes an electrically operated fluid discharging means and the temperature sensing means is effective to direct electric current to the fluid discharging means when necessary.

Two conditions must occur in a high temperature warewashing machine for the chemical sanitizing backup system to operate: The warewashing machine must be in its final rinse operation and the temperature of the final rinse water being introduced into the sanitizing operation work zone, generally by spraying, drops below the high temperature needed to sanitize the foodware. That sterilizing temperature is presently 180° F. and the temperature control unit of the sensing means of the invention is set to activate the dispensing means at that preset control temperature. The temperature control unit is effective to direct electric current to an electrically operated dispenser for providing fluid chemical sanitizing material to the final rinse water when the final rinse water temperature drops below the preset control temperature. A thermostat unit reads the final rinse water temperature at a final rinse water inlet of the sanitizing zone of the warewashing machine.

More specifically, the invention is directed to a backup sanitizing assembly used in combination with a high temperature warewashing machine having a sanitizing operation work zone into which high temperature final rinse water is directed to sanitize foodware disposed therein. The backup sanitizing assembly comprises container means for holding the fluid sanitizing material and dispensing means for discharging the fluid sanitizing material for delivery to the final rinse water being directed to the sanitizing operation work zone. Temperature sensing means determines the temperature of the final rinse water being directed into the sanitizing operation work zone. The assembly includes means for arming the temperature sensing means when the high temperature final rinse water is directed to the sanitizing operation work zone.

Once the temperature sensing means is armed and the temperature of said final rinse water is determined by the temperature sensing means to be outside a preselected sanitizing temperature range, the temperature sensing means is effective to provide signal means to activate the dispensing means to discharge the chemical sanitizing material in an amount sufficient to sanitize foodware disposed in the sanitizing operation work zone. Delivery means connected to the final rinse water directs the sufficient amount of fluid sanitizing material from the dispensing means to the sanitizing operation work zone.

The container means is disposed at a preselected location and the dispensing means discharges the fluid sanitizing material for delivery from the preselected location to the sanitizing operation work zone. The temperature sensing means includes signal generating means for producing actuating signal means directed to the dispensing means when the temperature of the final rinse water is outside the preselected sanitizing temperature range during the final rinse operation of the warewashing machine. The dispensing means is responsive to the actuating signal means to discharge the chemical sanitizing material in an amount sufficient to sanitize foodware disposed in the sanitizing operation work zone and delivery means directs the sufficient amount of sanitizing material from the dispensing means to the final rinse water originally being used to sanitize the foodware at the required high temperature before the final rinse water temperature dropped below the preset control temperature.

In a specific embodiment, the temperature sensing means produces actuating signal means when the temperature of final rinse water being supplied in said final rinse water line is outside the preselected sanitizing temperature range during the final rinse operation, and activating means responsive to the actuating signal means activates the dispensing means to discharge fluid sanitizing material for delivery to the sanitizing zone. The dispensing means includes metering means for measuring a sufficient amount of the chemical sanitizing material to sanitize the cleaned foodware. The dispensing means includes pump means for removing liquid sanitizing material from the container means and discharging it for delivery to the final rinse water being directed to the sanitizing operation work zone.

More particularly, the pump means includes a peristaltic pump and the delivery means includes check valve injector means connected to the final rinse line of the warewashing machine to deliver the sanitizing material and prevent backflow of water to the dispensing means. The dispensing means may include means for removing dry particulate sanitizing material from the container means and electrically operated solenoid means for discharging the particulate sanitizing material into a delivery water line that is connected to deliver the sanitizing material to the final rinse water.

The temperature sensing means includes actuating temperature setting means and electrical signal response means. The actuating temperature setting means is effective to establish a preselected actuating temperature at which the electrical signal response means directs an electric operating current to the dispensing means to provide the necessary sanitizing material to the final rinse water when the final rinse water temperature drops below the preselected temperature. The actuating temperature setting means includes a high temperature cut-off means for resetting the temperature sensing means to cease directing electric operating current to the dispensing means when the temperature of the final rinse water rises and returns to a predetermined point within the sanitizing temperature range. The temperature setting means may include a temperature control device having a temperature setting range of from about 140° F. to about 290° F. and means for setting a single activating temperature to provide an electric operating current to the dispensing means.

Other embodiments include an alarm system having an alarm means for producing, for example, a sound or flashing light, when the final rinse water temperature drops below a preselected sanitizing temperature as sensed by a temperature sensing means. Manual switch means may be used to turn the backup chemical sanitizing system on and off in response to the alarm system. As usual, electric current flows when the manually operated switch means is in a closed position and stops when the switch is in an open position. Otherwise, the backup system of the invention is designed to operate automatically with or without the use of an alarm system to alert operating personnel that the high temperature warewashing machine is functioning to chemically sanitize the foodware rather than sterilizing by a high temperature of at least 180° F.

In another embodiment of the invention, a backup sanitizing assembly is provided for a high temperature pot and pan sink including heating means for maintaining a bath of high temperature rinse water at a sanitizing temperature of at least 170° F. in a rinse operation, and a sanitizing operation work zone in which said bath of rinse water is located to sanitize foodware disposed therein. The sanitizing assembly comprises container means disposed at a preselected location for holding fluid sanitizing material to sanitize foodware disposed within the bath in the sanitizing operation work zone of the pot and pan sink and dispensing means for discharging fluid sanitizing material for delivery from the preselected location to the sanitizing operation work zone.

Temperature sensing means monitors the temperature of the bath rinse water being used to rinse foodware, and is electrically connected to the dispensing means and includes signal generating means for providing actuating signal means directed to the dispensing means when the temperature of the rinse water is below the preselected sanitizing temperature of the rinse water during the rinse operation. The dispensing means is responsive to the actuating signal means to discharge fluid sanitizing material in an amount sufficient to sanitize foodware disposed in the bath of rinse water. Delivery means directs a sufficient amount of fluid sanitizing material from the dispensing means to the bath of rinse water used in the sanitizing operation work zone.

In a specific embodiment of this assembly, the dispensing means includes pump means for removing liquid sanitizing material from the container means for delivery to the bath of rinse water, and metering means including timer means for setting the amount of time the pump means operates to deliver liquid sanitizing material to water used for the rinse water bath. The sanitizing material may be directly discharged into the bath of rinse water formed in the sanitizing operation work zone or into a waterline when water flows therethrough into the sanitizing work zone to form the bath of rinse water.

Another feature of the invention is directed to temperature sensing means including actuating temperature setting means and electrical signal response means having light indicator means. The actuating temperature setting means is effective to establish a preselected actuating temperature at which the electrical signal response means directs an electric operating current to the dispensing means for providing fluid sanitizing material to the bath of rinse water when the temperature of the rinse water drops below the preselected actuating temperature. The signal generating means includes manually operable switch means for providing the electric operating current to the dispensing means when the light indicator means is activated by the electric operating current to indicate that the temperature of the rinse water has dropped below the preselected actuating temperature.

A temperature setting means includes a temperature control device having means for setting a single activating temperature in a temperature setting range for providing an electric operating current for operating the dispensing means when the bath temperature of the rinse water drops below the single activating temperature. The temperature sensing means includes temperature displaying means for visually monitoring the temperature of the bath. In a specific embodiment, the temperature displaying means is a digital temperature display unit or LED water temperature indicator.

Another specific assembly of the invention comprises supply means providing a source of fluid sanitizing material that is effective to sanitize foodware. Temperature sensing means monitors the rinse water temperature of the bath of rinse water in a sanitizing operation work zone during a rinse operation of a pot and pan sink. Temperature-controlled dispensing means is responsive to temperature sensing means for providing an amount of fluid sanitizing material in the rinse water sufficient to sanitize foodware disposed in a sanitizing operation work zone when the rinse water temperature in the bath is below a preselected sanitizing temperature.

The dispensing means includes an electrically operated liquid discharging means, and the temperature sensing means is effective to cause electric current to be directed to the liquid discharging means to deliver the chemical sanitizing material to water used in the bath of rinse water when the rinse water temperature drops below a preset triggering temperature. The sink includes vertically disposed sidewalls which define the outer periphery of the bath of rinse water. The temperature sensing means includes sensor means mounted to a sidewall of the sink for reading the rinse water temperature in the bath in the sanitizing zone.

More specifically, the dispensing means includes indicator means, and the temperature sensing means is electrically connected to the indicator means to alert operating personnel that the water temperature of the bath is below a required sanitizing temperature. The dispensing means includes an electrically operated liquid discharging means and the temperature sensing means is electrically connected for directing electric current to the liquid discharging means. Manually operated switch means may be used to direct electric current to the liquid discharging means when in a closed position while precluding the flow of electric current to the liquid discharging means when in an open position. Alternatively, the dispensing means is automatically responsive to the temperature sensing means to direct the electric current to the liquid discharging means when the temperature sensing means determines that the water temperature of the bath of rinse water is insufficient to sanitize foodware in the sanitizing zone.

A method of the invention comprises providing a source of liquid sanitizing material that is effective to sanitize foodware, dispensing means for providing liquid sanitizing material to a sanitizing operation work zone of a pot and pan sink, and temperature sensing means for sensing the temperature of heated water in a bath of rinse water heated to an elevated preselected sanitizing temperature; sensing the temperature of the water in the bath of heated rinse water being used to sanitize foodware disposed within the sanitizing operation work zone during a rinse operation of the pot and pan sink; and activating the dispensing means for discharging sanitizing material when the temperature sensing means indicates that the temperature of the bath of rinse water is sensed to be below the preselected sanitizing temperature to provide an amount of the fluid sanitizing material in the bath of rinse water sufficient to sanitize foodware disposed in the sanitizing operation work zone.

An assembly for effecting the method of the invention comprises heating means for providing a bath of heated rinse water at an elevated preselected sanitizing temperature in the sanitizing operation work zone in which the heated rinse water is to sanitize foodware disposed therein. Container means provides a source of liquid sanitizing material that is effective to sanitize foodware. Dispensing means provides liquid sanitizing material to the sanitizing operation work zone, and temperature sensing means senses the temperature of the water in the bath of heated rinse water being used to sanitize foodware disposed within the sanitizing operation work zone during a rinse operation of the pot and pan sink. Actuating means activates the dispensing means for providing sanitizing material when the temperature sensing means indicates that the temperature of the bath of rinse water is sensed to be below the preselected sanitizing temperature to provide an amount of fluid sanitizing material in the bath of rinse water sufficient to sanitize foodware disposed in the sanitizing operation work zone.

BRIEF DESCRIPTION OF THE DRAWINGS

Other objects of this invention will appear in the following description and claims, reference being made to the accompanying drawings forming a part of the specification wherein like reference characters designate corresponding parts in the several views.

DETAILED DESCRIPTION

Figure 1:
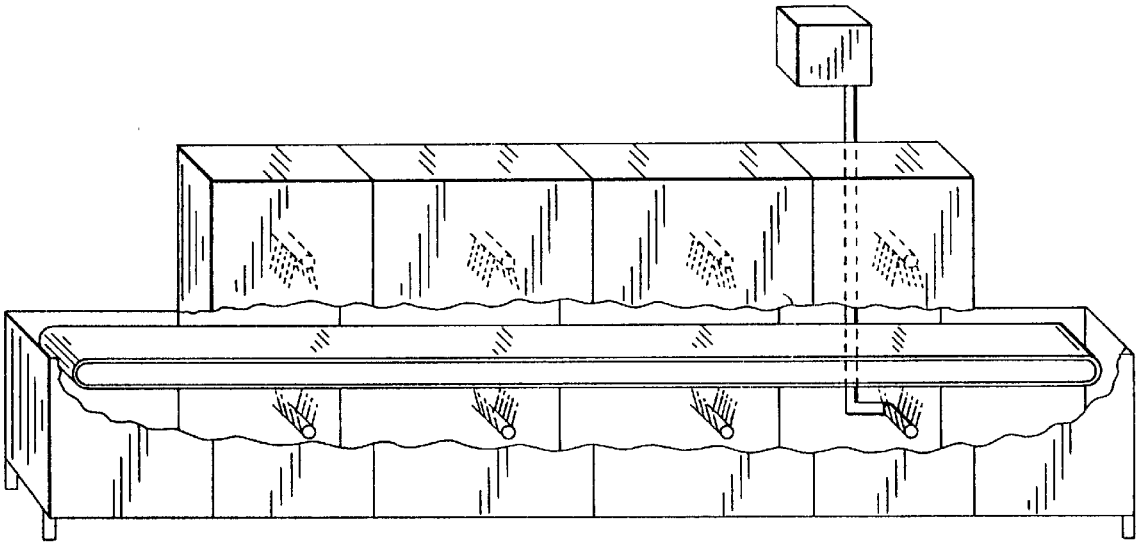
FIG. 1 is a fragmentary diagrammatic perspective view of a conveyor-type warewashing machine in which the backup chemical sanitizing system of this invention may be retrofit or incorporated as part of the original equipment.
Figure 2:
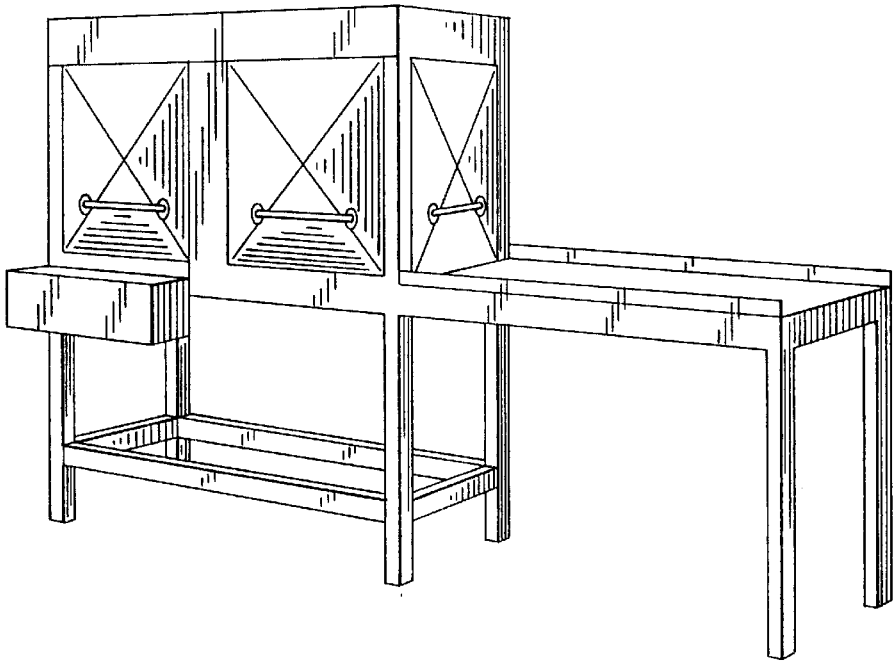
FIG. 2 is a diagrammatic perspective view of a two-compartment warewashing machine for use with the backup sanitizing system of the invention.
Figure 3:
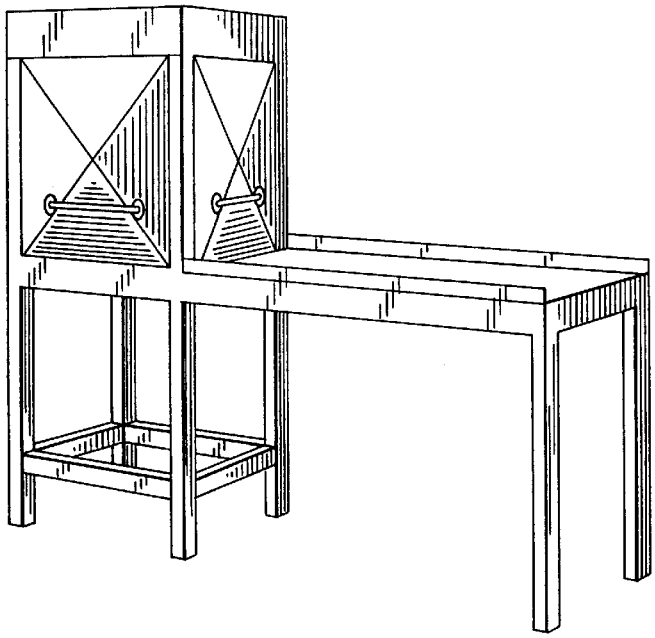
FIG. 3 is a diagrammatic perspective view of a single chamber batch-type warewashing machine for use with the invention.

An embodiment of the conveyor-type warewashing machine of FIG. 1 is disclosed in U.S. Pat. No. 3,896,827; the two-compartment machine of FIG. 2 is shown in U.S. Pat. No. 2,947,311; and the single chamber machine is shown in U.S. Pat. No. 4,147,559. The disclosures of the U.S. Pat. Nos. 3,896,827; 2,947,311; and 4,147,559 are each hereby incorporated by reference each in its respective entirety. The system of the invention is designed to operate in combination with these or other warewashing machines capable of operating with high temperature final rinse water to sterilize foodware after the washing cycles of the machines are completed. In other words, the backup system of the invention will work effectively on any and all brands of high temperature warewashing machines.

Figure 4:
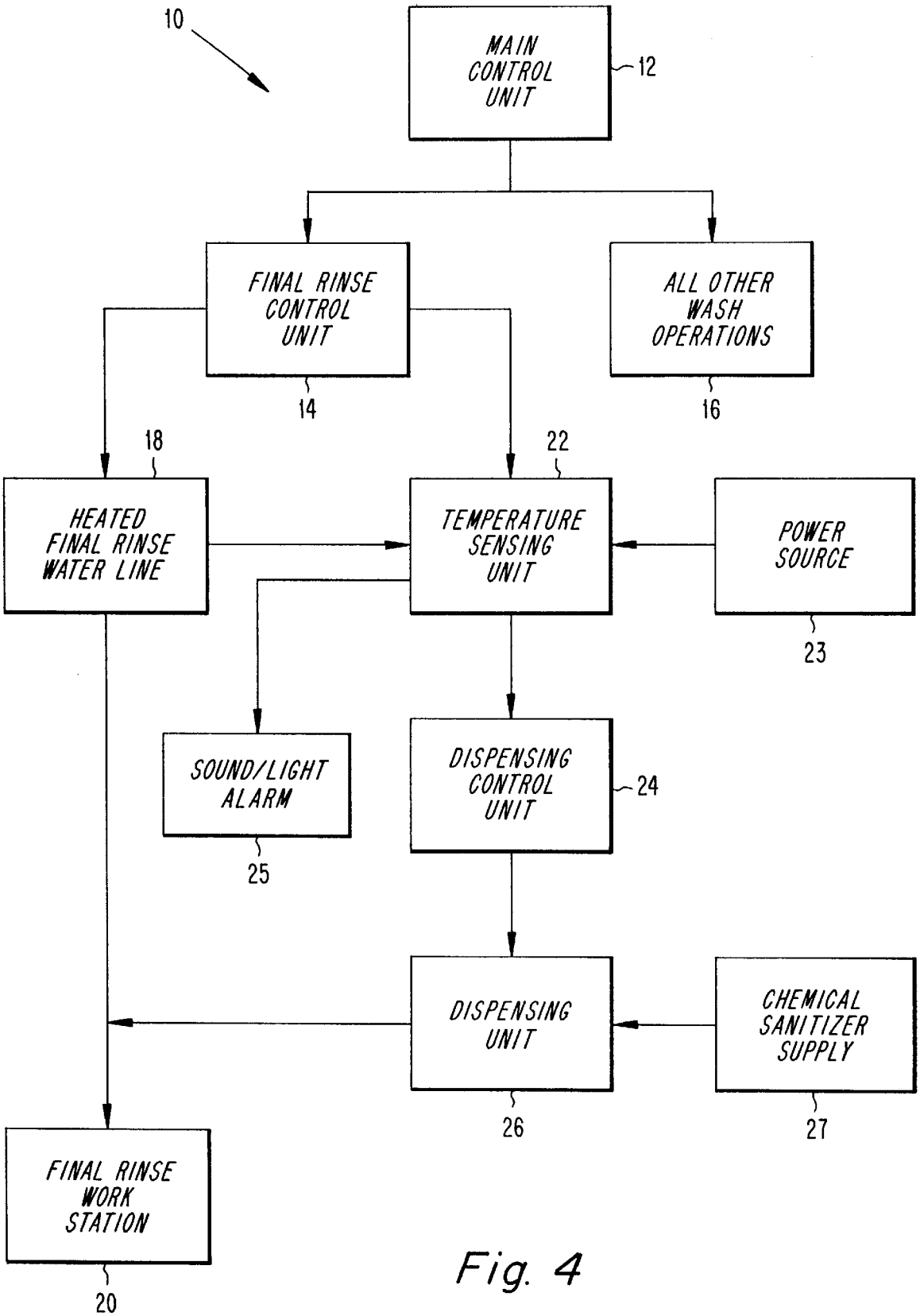
FIG. 4 is a flow diagram showing various operating details of the chemical sanitizing backup method and apparatus of the invention.

The backup system, generally designated 10, in FIG. 4 shows the main control unit 12 of a warewashing machine with a final rinse control unit 14 electrically connected to activate the flow of heated final rinse water through the heated final rinse water line 18 to the final rinse work station 20 of the warewashing machine. The final rinse phase in which the foodware is sterilized by the final rinse water maintained at a sanitizing temperature of at least 180° F. is effected after the main control unit directs electrical power to all of the previous wash operations 16.

Temperature sensing or control unit 22 has a temperature adjustment capable of allowing electric current to flow from power source 23 to dispensing control unit 24 for operating dispensing unit 26 whenever the final rinse water temperature is less than a preset preselected triggering temperature. Temperature control unit 22 is electrically connected to receive operating current only when an activating signal is received from final rinse control unit 14. Alternatively, the activating signal may come directly from main control unit 12. This arrangement constitutes the arming means for temperature control unit 22 to begin monitoring the temperature of the final rinse water in water line 18.

Once temperature control unit 22 is armed, dispensing unit 26 is energized if the final rinse water temperature falls below the preset preselected triggering temperature, which is generally 180° F., and chemical sanitizer material is discharged from chemical sanitizer supply 27 into final rinse water line 18 as shown. Dispensing unit 26 may be any commercially available device that will discharge fluid sanitizing material into water line 18 so long as the final rinse water temperature is insufficient to sterilize the foodware. Once the water temperature is increased to rise above the triggering temperature, control unit 22 may be set to shut-off and thereby stop the flow of electric power supply 23 to dispensing unit 26. Thus described herein, dispensing unit 26 is temperature-controlled to discharge sanitizing material into the final rinse water only when the final rinse water temperature is below the accepted sanitizing temperature.

Temperature control unit 22 is electrically connected to alarm unit 25 which may produce either a sound or a light signal or both. This alerts the operating personnel that the temperature of the final rinse water must be restored to a sterilizing level. Dispensing control unit 24 and dispensing unit 26 operate automatically in the system shown in FIG. 4. Another embodiment includes a manually operated switch located between power source 23 and dispensing unit 24/26 for personnel to manually switch on the electric power upon being alerted by the sound/light alarm 25.

Temperature control unit 22 directs electric current to dispensing control unit 24 and dispensing unit 26 only when two conditions exist: the final rinse operation of the warewashing machine is activated, and the final rinse water temperature drops below a desired sanitizing temperature. In this embodiment temperature control unit 22 is an electrically operated, surface mounted device designated Series A19D and manufactured by Johnson Controls, Inc. as diagrammatically shown in FIG. 7 and discussed below. Temperature control unit 22 may be mounted in many different places. The temperature reading itself, however, must come from the water in the final rinse line 18 of the warewashing machine.

Figure 5:
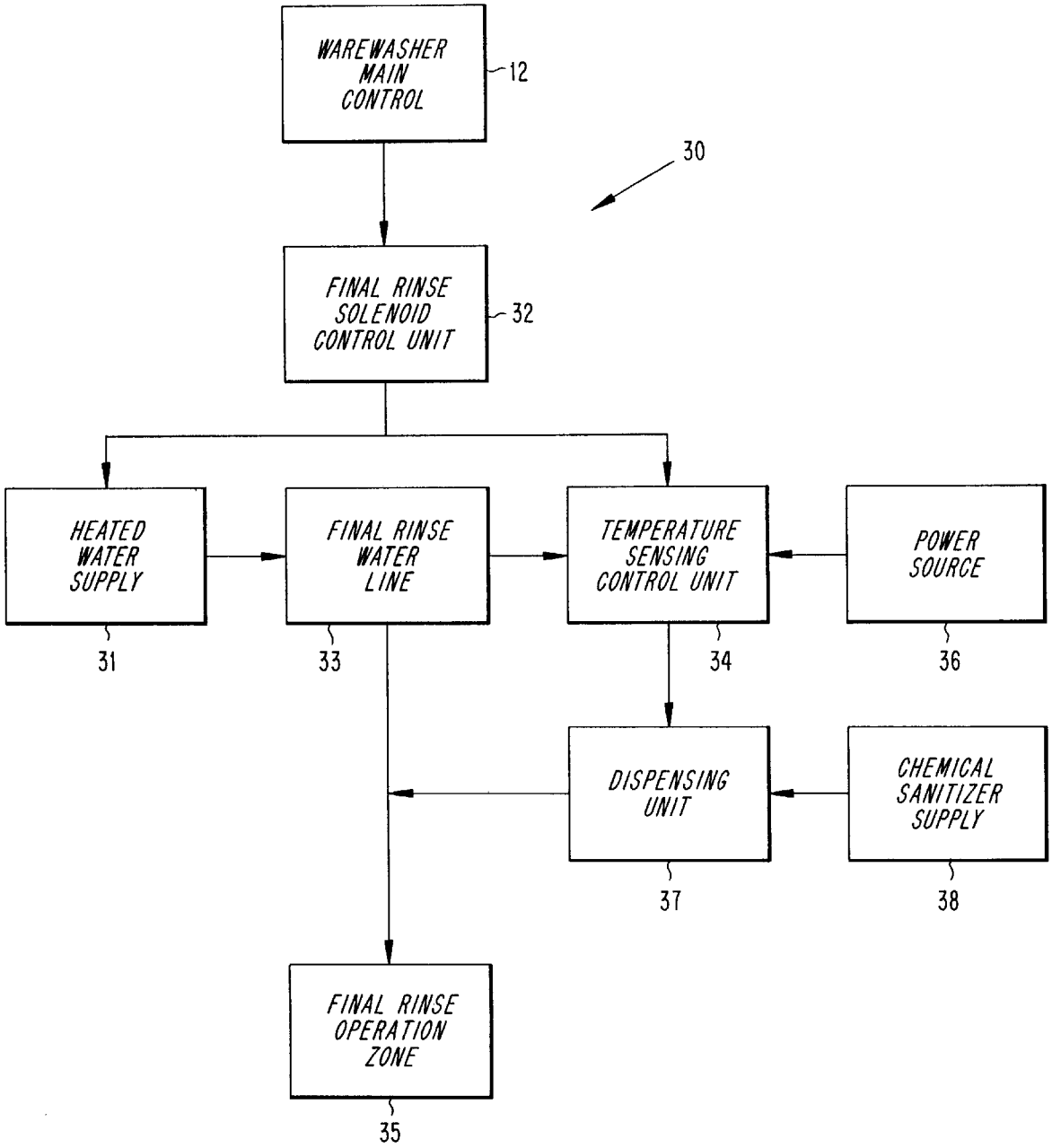
FIG. 5 is a flow diagram showing other operating details of the chemical sanitizing backup method and assembly of the invention.

FIG. 5 shows the backup system embodiment, generally designated 30, with temperature sensing or control unit 34 mounted between the final rinse water solenoid control unit 32 and a location where the final rinse line 33 receives heated water from supply 31 and directs it into the final rinse operation zone 35. A probe type temperature control unit 34 must be mounted close to or on the warewashing machine with a temperature sensing element attached to read the temperature of the final rinse water being used in final rinse operation zone 35. When solenoid control unit 32 is turned on by warewashing main control 12, temperature control unit 34 is armed. If the temperature in final rinse water line 33 drops below the preset preselected triggering temperature, temperature control unit 34 connects power source 36 to dispensing unit 37 to deliver chemical sanitizer material to water line 33 from sanitizer supply 38 until the final rinse water temperature is restored to a sterilizing level.

The electrical power supplied by temperature control unit 34 is wired into dispensing unit 37, which may vary widely depending on the type fluid sanitizing material being used. In a specific embodiment shown in FIG. 6, a peristaltic pump 40 pumps liquid sanitizer from container 42 into final rinse water line 45. Pump 40 receives power from supply 46 when connected through a final rinse solenoid control unit 41 and is thereby armed. Pump 40 does not pump chemical sanitizer until a further electric signal actuates pump 40 through temperature control unit 43.

Chemical injection device 44 feeds the liquid sanitizer into line 45 while preventing backflow to pump 40. Chemical injection device 44 may be selected from any number of check valve injectors commercially available from various suppliers and is disposed at a location immediately before the final rinse water enters machine 50 to sanitize foodware 48 retained in rack 49 within the final rinse operation zone. Warewasher 50 operates in its normal manner as determined by its main control panel and is not affected by the operation of the backup sanitizing system of the invention.

Peristaltic pump 40 has a speed adjustment for properly regulating the amount of chemical sanitizer to be dispensed. The faster pump 40 operates, larger amounts of the chemical are dispensed. The slower the impeller of pump 40 rotates, the sanitizing chemical is dispensed in lesser amounts. Different warewashing machines may require temperature unit 43 to operate at differing voltages: 24, 120, 208, or 240 volts. Peristaltic pump 40 may be selected from any of those commercially available for effecting the method of the invention. If dry particulate sanitizer material is used, an additional water delivery line is required for receiving dispensed particulate material to be carried by the water in the delivery line through injector check valve 44.

A proportioner or vacuum siphoning injector device connected to draw chemical sanitizer from a containered supply to the final rinse water may be manually or automatically turned on to deliver the sanitizer when the rinse water temperature drops below the desired sanitizing temperature. Such an injector device may be used instead of a pump as a dispensing means.

Figure 7:
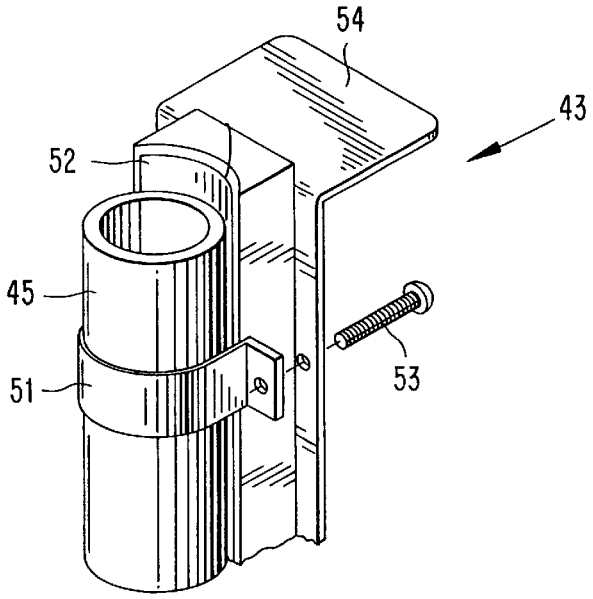
FIG. 7 is a fragmentary perspective view of a temperature sensing unit as used in the assembly combination of FIG. 6.

FIG. 7 shows temperature control device 43 connected to final rinse water line 45 with mounting strap 51 that is fastened to case 54 with clamping screw 53. Sensing element 52 is contiguously disposed to the outer surface of water line 45, which is made of copper and thereby accurately reflects the actual temperature of the final rinse water being directed into warewasher 50.

The sanitizing system of the invention is designed to dispense a solution of sanitizing material such as sodium hypochlorite or ammonium chloride commercially known as QUAT-X sold and distributed by H & H Products of Dunn, N.C. Studies conducted with respect to commercial dishwashers using the backup sanitizing system of the invention were run at respective final rinse temperatures of 158° F. and 140° F. at respective discharge rates of 86 milligrams per liter of chlorine and 98 milligrams per liter of chlorine during the final rinse of the dishwashers at 20 psi flow pressure. The concentration of *E. coli* bacteria was nondetectable on glasses that were washed in the commercial dishwashers after the final rinse cycle. This was determined by finding that the sanitized glasses carried a minimum of 50 parts per million (ppm) of the chemical sanitizer on their surfaces. The chlorine concentration requirement by the government in the first rinse is 100 parts per million or less. These are standard operating parameters set by the testing agency.

Figure 6:
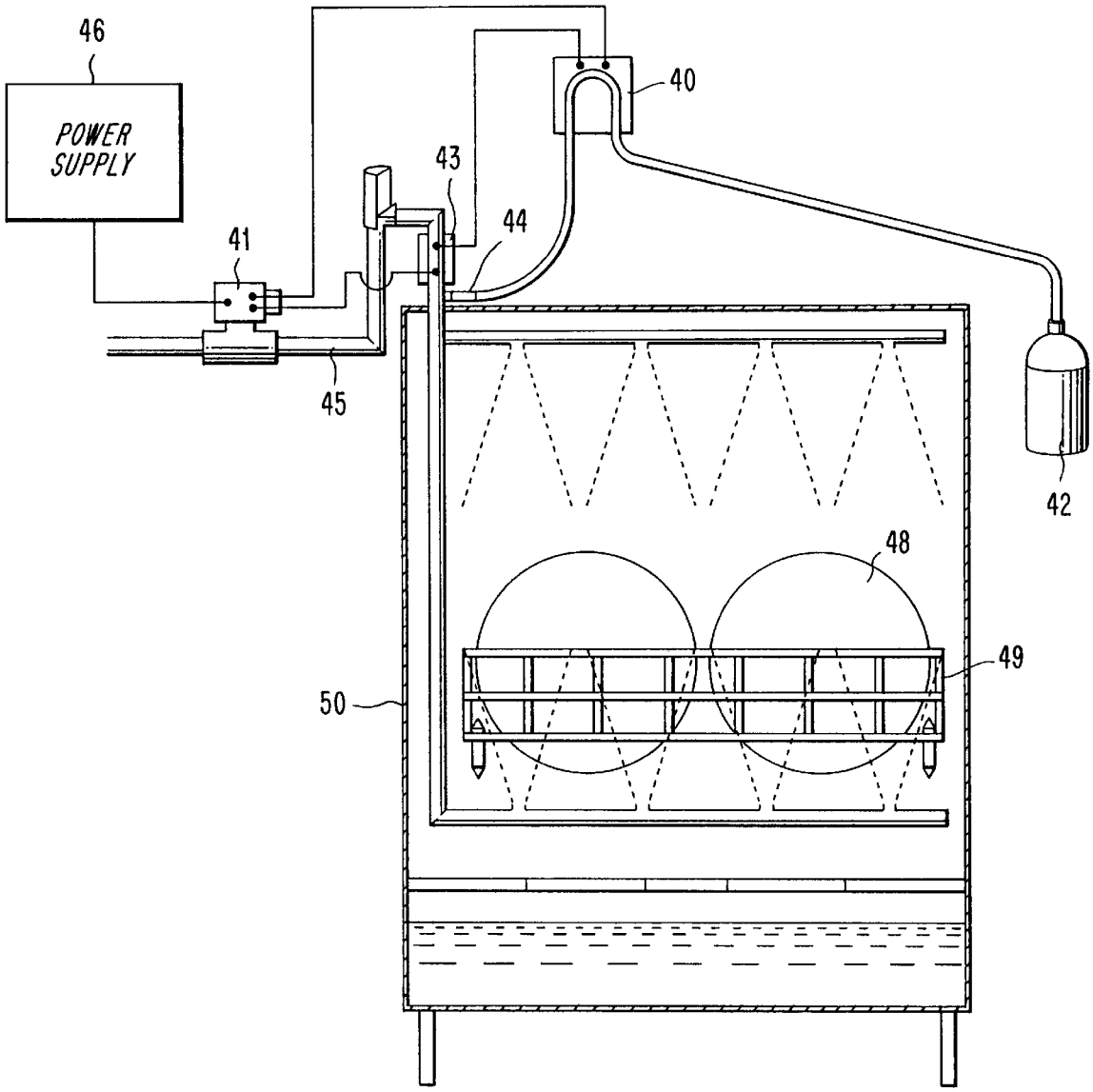
FIG. 6 is a diagrammatic sectional view of a warewashing machine showing a rack of foodware located in the final rinse compartment and the chemical sanitizing backup assembly operatively connected to the warewashing machine.
Figure 8:
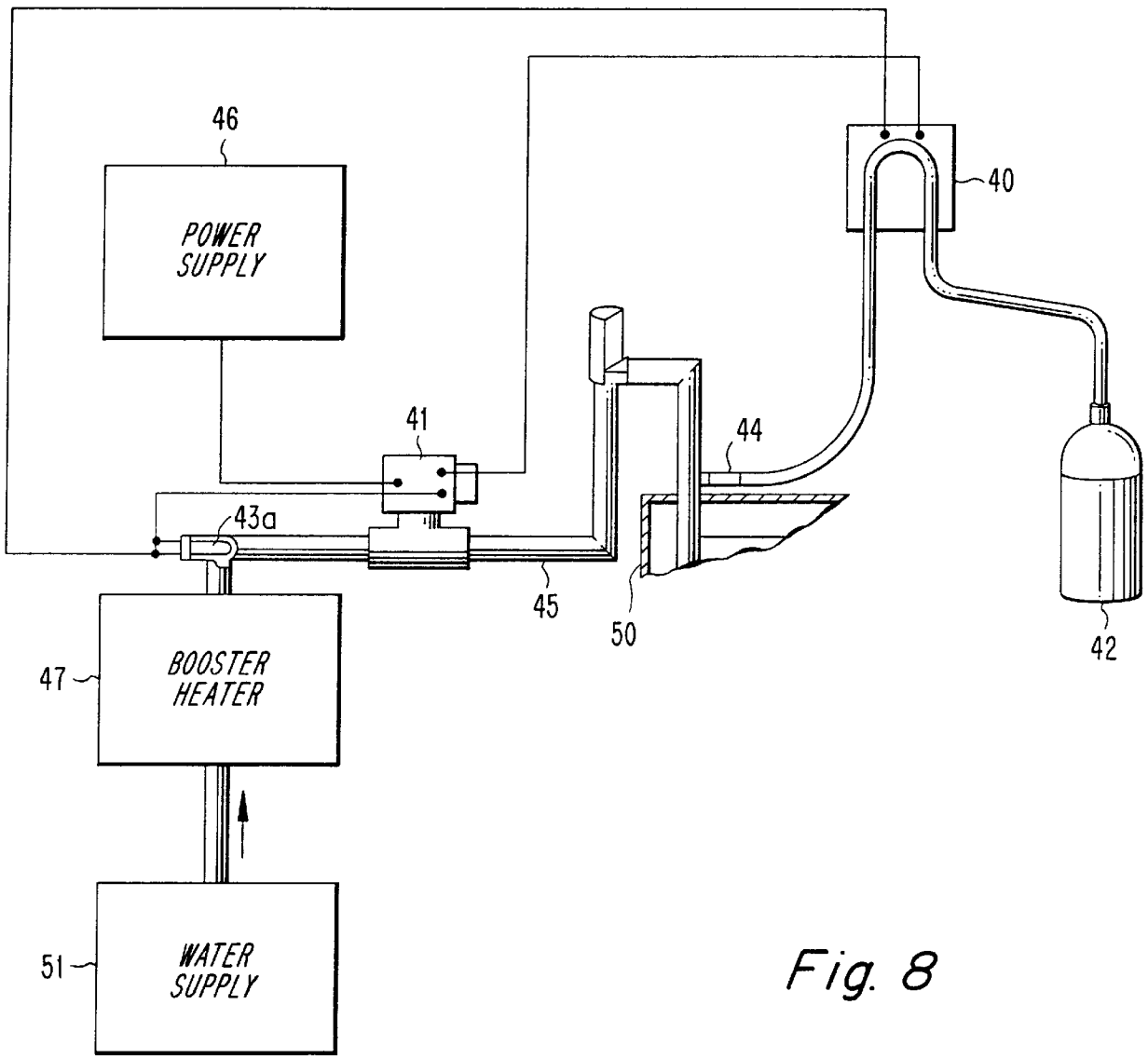
FIG. 8 is a fragmentary diagrammatic flow diagram of another embodiment of the invention as shown in FIG. 6 using a temperature sensing probe member.

The embodiment of FIG. 8 constitutes an alternative method of measuring the inline water temperature using a standard temperature sensing probe 43*a* which includes sensing elements disposed within a bulbwell. Booster heater 47 heats the water from water supply 51 and directs it through the valve controlled by solenoid 41. Temperature sensing probe 43*a* is disposed directly in the waterline to measure rinse water temperature between booster heater 47 and solenoid 41 as shown. The operation of the dispensing mechanism with probe 43*a* works precisely the same as in the earlier embodiment as shown in FIG. 6 which uses sensing device 43 as shown in FIG. 7.

Figure 9:
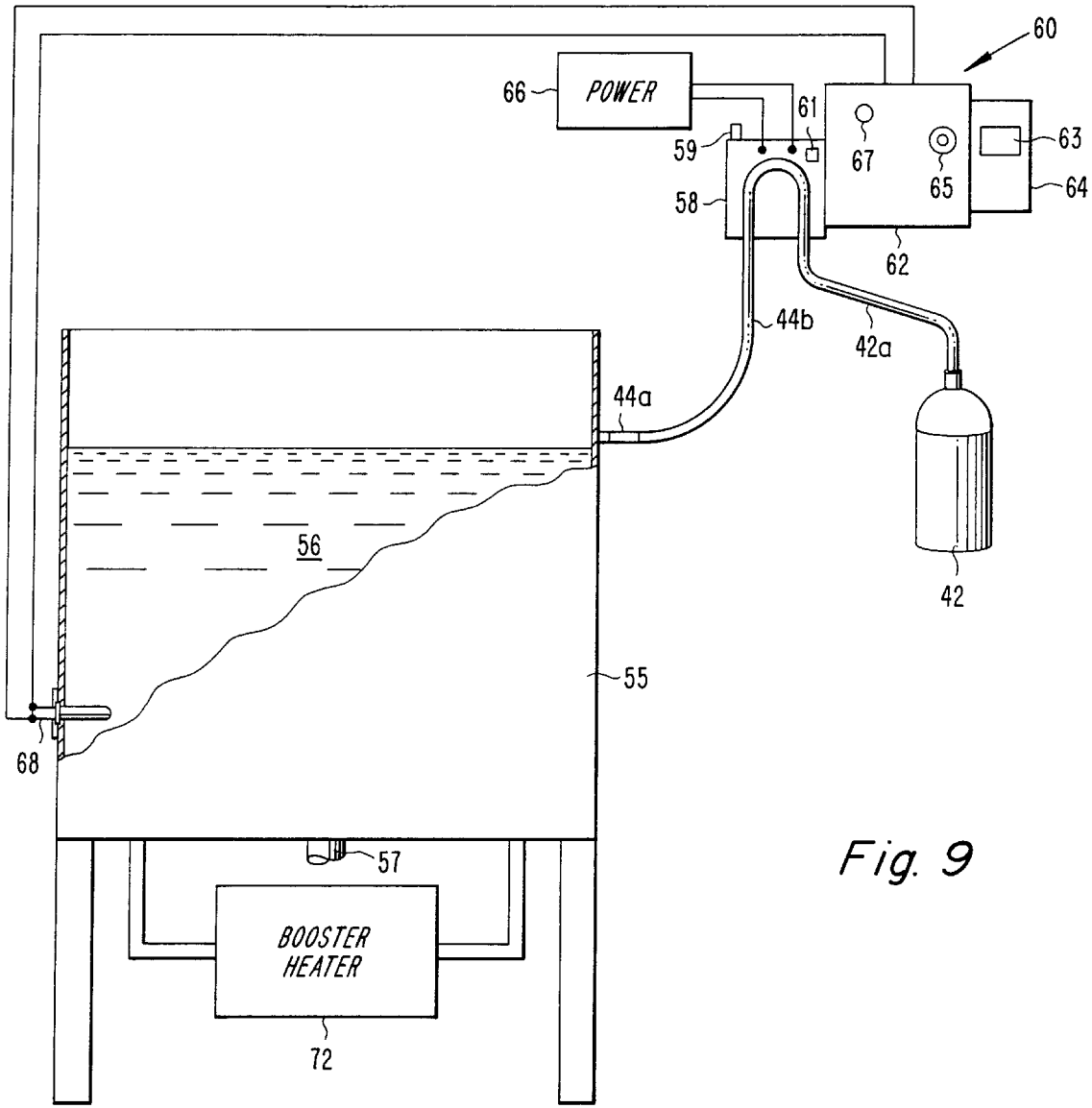
FIG. 9 is a fragmentary diagrammatic side elevational view of a pot and pan sink assembly in combination with the sanitizing system of the invention.

In FIG. 9, a pot and pan sink assembly is shown equipped with a backup sanitizing assembly of the invention. The depicted pot and pan sink assembly is generally used in military installations and includes three open sinks. The first sink is used to wash the pot and pan foodware, a second or middle sink is used to effect a first rinse, and a third sink contains a high temperature sanitizing bath of rinse water to be maintained at temperature of at least 170° F. The automatic warewashing machines shown in FIGS. 1 and 2 are enclosed. The pot and pan sink, however, is open and manually operated. Government regulatory agencies such as OSHA require the water temperature to be lower for pot and pan assembly use to avoid burning kitchen personnel. Many systems have a standard booster heater 47 to heat water in the main waterline from the water supply to be used in the automatic dishwashers as shown in FIG. 8.

Figure 10:
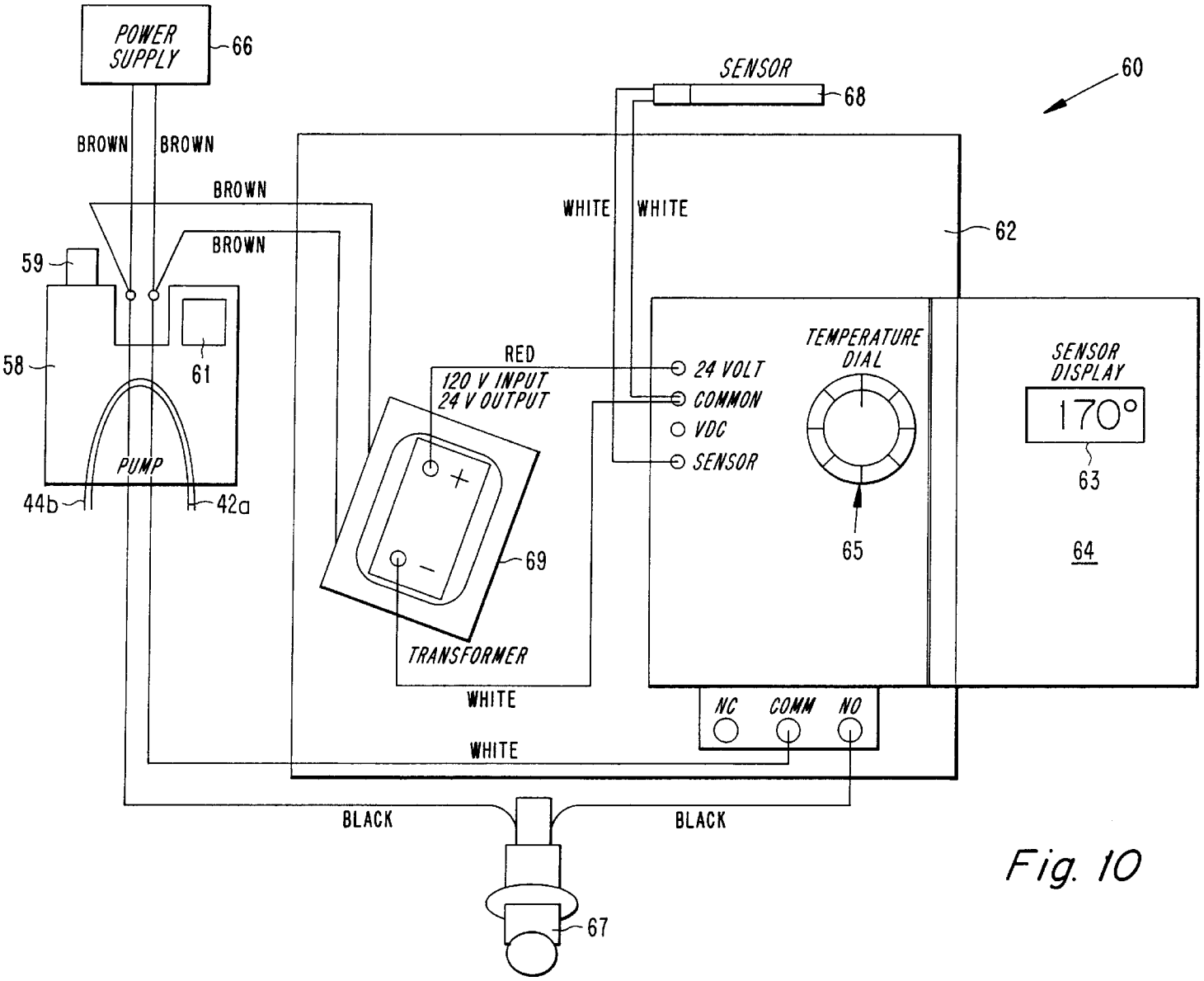
FIG. 10 is a schematic circuit diagram for the temperature-controlled dispensing mechanism of the invention.

The pot and pan sinks, however, include an auxiliary booster heater 72 mounted below the third sink 55 which is defined by vertical sidewalls that contain a bath 56 of rinse water. Booster heater 72 is designed to maintain the temperature of bath 56 at a temperature of at least 170° F. as required by government regulation. Booster heater 72 is connected to two different openings in the bottom of sink 55. Water is drawn through the first opening into booster heater 72, heated to the proper temperature, and returned to bath 56 through the second bottom opening of sink 55. Booster heater 72 is generally smaller than booster heater 47 and operates continuously to maintain the required water temperature. If the water temperature drops below 170° F., a major problem occurs in the kitchen facility, and the personnel are required to stop their operation. The backup chemical sanitizing assembly disclosed in the earlier embodiments has therefore been adapted to the pot and pan sink as shown in FIGS. 9 and 10.

Temperature sensing device 68 comprises a standard sensing element in a bulbwell to form a temperature sensing probe shown mounted through the front sidewall of sink 55, monitors the bath temperature, and sends a signal to the temperature controlled dispensing system, generally designated 60 under described conditions. When the bath temperature drops below the required 170° F., peristaltic pump 58 is activated and delivers liquid sanitizer from container 42 through lines 42*a* and 44*b*, and through discharge mechanism 44*a* directly above and into bath 56 as shown.

Actuating signal mechanism 62 for controlling pump 58 includes transformer 69 that reduces the 120 volt A.C. power supply 66 to 24 volt A.C. output to operate sensor display mechanism 64 and the required switch mechanisms that turn on the indicator means of the system. Display screen 63 shows a temperature of 170° F. in FIG. 10. If the temperature drops below 170° F. as set on temperature setting dial 65, indicator light 67, which is normally off, is turned on through an internal switch of control unit 62. Kitchen personnel in charge of the pot and pan sink then simply pushes manual actuating button 59 to activate peristaltic pump 58. Dispensing unit 60 is set to discharge liquid sanitizing material from container 42 into bath 56 in a measured amount. An internal timer mechanism causes pump 58 to operate for a predetermined and preset amount of time to dispense at least 4 ounces of QUAT-X sanitizing material into 20 gallons of water used to form rinse water bath 56. While peristaltic pump 58 is pumping, indicator light 61 is lighted to show that sanitizing material is being discharged into bath 56.

It is possible to direct the flow of sanitizing material directly into the main waterline as in the earlier embodiment as shown in FIGS. 6 and 8. Temperature sensing probe 68, however, is mounted in the sidewall of the rinse sink 55 as shown.

While the backup assembly and method for chemical sanitizing in a sanitizing zone of a pot and pan sink has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A backup sanitizing assembly for a high temperature pot and pan sink including heating means for maintaining a bath of high temperature rinse water at a sanitizing temperature of at least 170° F. in a rinse operation, and a sanitizing operation work zone in which said bath of rinse water is located to sanitize foodware disposed therein, said sanitizing assembly comprising:

a) container means disposed at a preselected location for holding fluid sanitizing material to sanitize foodware disposed within said bath in said sanitizing operation work zone of the pot and pan sink, b) dispensing means for discharging said fluid sanitizing material for delivery from said preselected location to said sanitizing operation work zone, c) temperature sensing means for determining the temperature of said rinse water of said bath being used to rinse foodware disposed within said sanitizing operation work zone, d) said temperature sensing means being electrically connected to said dispensing means and including signal generating means for providing actuating signal means directed to said dispensing means when the temperature of said rinse water is below said sanitizing temperature of said rinse water during said rinse operation, e) said dispensing means being responsive to said actuating signal means to discharge said fluid sanitizing material in an amount sufficient to sanitize foodware disposed in said rinse water in said sanitizing operation work zone, and f) delivery means for directing said sufficient amount of fluid sanitizing material from said dispensing means to said bath of said rinse water used in said sanitizing operation work zone.

2. An assembly as defined in claim 1 wherein said fluid sanitizing material is liquid, and said dispensing means includes pump means for removing liquid sanitizing material from said container means for delivery to said bath of said rinse water in said sanitizing operation work zone.

3. An assembly as defined in claim 1 wherein said dispensing means includes metering means for measuring an amount of said fluid sanitizing material sufficient to sanitize foodware disposed in said sanitizing operation work zone.

4. An assembly as defined in claim 3 wherein said fluid sanitizing material is liquid, and said dispensing means includes pump means for removing liquid sanitizing material from said container means for delivery to said bath of said rinse water in said sanitizing operation work zone, and said metering means includes timer means for setting the amount of time said pump means operates to deliver liquid sanitizing material to said rinse water for said bath.

5. An assembly as defined in claims 1 wherein said delivery means includes means for directing said sanitizing material directly into said bath of rinse water formed in said sanitizing operation work zone.

6. An assembly as defined in claim 1 wherein water is directed through a waterline to said sanitizing operation work zone of said pot and pan sink, and said delivery means includes means for directing said sanitizing material into said waterline as water flows therethrough into said sanitizing operation work zone to form said bath of said rinse water.

7. An assembly as defined in claim 1 wherein said temperature sensing means includes actuating temperature setting means and electrical signal response means, said actuating temperature setting means being effective to establish a preselected actuating temperature at which the electrical signal response means directs an electric operating current to said dispensing means for providing said fluid sanitizing material to said rinse water of said bath when the temperature of said rinse water drops below said preselected actuating temperature.

8. An assembly as defined in claim 7 wherein said electrical signal response means includes light indicator means, and said signal generating means includes manually operable switch means for providing said electric operating current for said dispensing means when said light indicator means is activated by said electric operating current to indicate that the temperature of said rinse water of said bath has dropped below said preselected actuating temperature.

9. An assembly as defined in claim 1 wherein said fluid sanitizing material is liquid, said temperature setting means includes a temperature control device having means for setting a single activating temperature in a temperature setting range for providing an electric operating current for said dispensing means when the temperature of the rinse water of said bath drops below said single activating temperature, said dispensing means includes pump means for removing said liquid sanitizing material from said container means when activating said electric operating current for delivery of sanitizing material to said rinse water forming said bath.

10. An assembly as defined in claim 1 wherein said temperature sensing means includes temperature displaying means for visually monitoring the temperature of said bath.

11. An assembly as defined in claim 10 wherein said temperature displaying means is a digital temperature display unit.

12. An assembly for sanitizing foodware in a pot and pan sink wherein a bath of rinse water is maintained at a sanitizing temperature of at least 170° F. in a sanitizing operation work zone in which said bath of rinse water is used to sanitize foodware disposed therein, said assembly comprising:

a) supply means providing a source of fluid sanitizing material that is effective to sanitize foodware, b) temperature sensing means for monitoring the rinse water temperature of said bath of rinse water in said sanitizing operation work zone during a rinse operation of the pot and pan sink, and c) temperature-controlled dispensing means responsive to said temperature sensing means for providing an amount of said fluid sanitizing material in said rinse water sufficient to sanitize foodware disposed in said sanitizing operation work zone when said rinse water temperature in said bath is below said sanitizing temperature.

13. An assembly as defined in claim 12 wherein said supply means includes container means for containing liquid chemical sanitizing material, and said dispensing means is effective to direct said liquid chemical sanitizing material from said container means and into said rinse water of said bath to be used in said sanitizing zone.

14. As assembly as defined in claim 12 wherein said dispensing means includes an electrically operated liquid discharging means, and said temperature sensing means is effective to cause electric current to be directed to said liquid discharging means to deliver said chemical sanitizing material to water used in said bath of rinse water when the rinse water temperature drops below a preset triggering temperature.

15. An assembly as defined in claim 12 wherein said sink includes vertically disposed sidewalls which define the outer periphery of said bath of rinse water, said temperature sensing means includes sensor means mounted to a sidewall of said sink for reading the rinse water temperature in said bath in said sanitizing zone.

16. An assembly as defined in claim 12 wherein said dispensing means includes indicator means, and said temperature sensing means is electrically connected to said indicator means to alert operating personnel that the water temperature of said bath of rinse water is below a required sanitizing temperature.

17. An assembly as defined in claim 16 wherein said dispensing means includes an electrically operated liquid discharging means, said temperature sensing means is electrically connected for directing electric current to said liquid discharging means, and manually operated switch means is effective to direct said electric current to said liquid discharging means when in a closed position and precludes the flow of electric current to said liquid discharging means when in an open position.

18. An assembly as defined in claim 16 wherein said dispensing means includes an electrically operated liquid discharging means, said temperature sensing means is electrically connected for directing electric current to said liquid discharging means, and said dispensing means is automatically responsive to said temperature sensing means to direct said electric current to said liquid discharging means when said temperature sensing means determines that the water temperature of said bath of rinse water is insufficient to sanitize foodware in said sanitizing zone.

19. A method of sanitizing foodware in a pot and pan sink assembly including heating means for providing a bath of heated rinse water at an elevated preselected sanitizing temperature in a sanitizing operation work zone in which said heated rinse water is to sanitize foodware disposed therein, said method comprising:

a) providing a source of liquid sanitizing material that is effective to sanitize foodware, dispensing means for providing said liquid sanitizing material to said sanitizing operation work zone, and temperature sensing means for sensing the temperature of said heated rinse water in said bath, b) sensing the temperature of the water in said bath of heated rinse water being used to sanitize foodware disposed within said sanitizing operation work zone during a rinse operation of said pot and pan sink, and c) activating said dispensing means for discharging said sanitizing material when said temperature sensing means indicates that the temperature of said bath of rinse water is sensed to be below said preselected sanitizing temperature to provide an amount of said fluid sanitizing material in said bath of rinse water sufficient to sanitize foodware disposed in said sanitizing operation work zone.

20. An assembly for sanitizing foodware in a pot and pan sink including a sanitizing operation work zone, said assembly comprising:

a) heating means for providing a bath of heated rinse water at an elevated preselected sanitizing temperature in said sanitizing operation work zone in which said heated rinse water is to sanitize foodware disposed therein, b) container means providing a source of liquid sanitizing material that is effective to sanitize foodware, c) dispensing means for providing said liquid sanitizing material into said sanitizing operation work zone, d) temperature sensing means for sensing the temperature of the water in said bath of heated rinse water being used to sanitize foodware disposed within said sanitizing operation work zone during a rinse operation of said pot and pan sink, and e) actuating means for activating said dispensing means for providing said sanitizing material when said temperature sensing means indicates that the temperature of said bath of rinse water is sensed to be below said preselected sanitizing temperature to provide an amount of said fluid sanitizing material in said bath of rinse water sufficient to sanitize foodware disposed in said sanitizing operation work zone.

21. A high temperature warewashing assembly wherein high temperature rinse water is maintained at a preselected elevated sanitizing temperature during a rinse operation, said assembly comprising:

a) means defining a sanitizing operation work zone into which said high temperature rinse water is located for effecting sanitizing contact with foodware disposed therein, b) container means for holding fluid sanitizing material that is effective to sanitize foodware, c) means for supporting said container means at a preselected location with respect to said sanitizing operation work zone, d) temperature-controlled dispensing means for providing said fluid sanitizing material for delivery from said preselected location to said sanitizing operation work zone until the rinse water temperature is restored to said preselected elevated sanitizing temperature, and e) temperature sensing means for producing actuating signal means when the temperature of said rinse water being used is below said sanitizing temperature for effecting said sanitizing contact with the foodware during said rinse operation, f) said temperature-controlled dispensing means being responsive to said actuating signal means for activating said dispensing means to discharge fluid sanitizing material for delivery to said sanitizing operation work zone.

22. An assembly as defined in claim 21 wherein said warewashing assembly comprises a high temperature pot and pan sink including heating means for maintaining a bath of high temperature rinse water at a sanitizing temperature of at least 170° F. in a rinse operation, and said bath of rinse water is located in said sanitizing operation work zone.

23. An assembly as defined in claim 22 wherein said fluid sanitizing material is liquid, and said dispensing means includes metering means for measuring an amount of said liquid sanitizing material sufficient to sanitize foodware disposed in said sanitizing operation work zone, and pump means for removing liquid sanitizing material from said container means for delivery to said bath of rinse water, and said metering means includes timer means for setting the amount of time said pump means operates to deliver liquid sanitizing material to said rinse water for said bath.

24. An assembly as defined in claims 22 wherein said temperature sensing means includes sensor means having a temperature sensing element disposed in a bulbwell which is mounted to project directly into said bath of rinse water formed in said sanitizing operation work zone.

25. An assembly as defined in claim 21 wherein water is directed through a waterline to said sanitizing operation work zone of warewashing assembly, and said temperature sensing means includes sensor means having a temperature sensing element disposed in a bulbwell which is mounted to project directly into said waterline as water flows therethrough into said sanitizing operation work zone.

* * * * *